US008201539B2

(12) United States Patent
Conner

(10) Patent No.: US 8,201,539 B2
(45) Date of Patent: Jun. 19, 2012

(54) CARBURETOR COVER

(76) Inventor: Kelvin Conner, Detroit, MI (US)

( * ) Notice: Subject to any disclaimer, the term of this patent is extended or adjusted under 35 U.S.C. 154(b) by 0 days.

(21) Appl. No.: 12/930,375

(22) Filed: Jan. 5, 2011

(65) Prior Publication Data

US 2011/0162616 A1 Jul. 7, 2011

Related U.S. Application Data

(60) Provisional application No. 61/335,460, filed on Jan. 7, 2010.

(51) Int. Cl.
*F02B 77/04* (2006.01)

(52) U.S. Cl. ..... 123/198 E

(58) Field of Classification Search ..... 123/198 E
See application file for complete search history.

(56) References Cited

U.S. PATENT DOCUMENTS 3,612,024 A * 10/1971 Bandimere ..... 55/312
3,710,562 A * 1/1973 McKenzie ..... 55/487
5,100,443 A * 3/1992 Berto ..... 55/385.3
5,688,299 A * 11/1997 Goodwin ..... 55/385.3
6,216,661 B1 * 4/2001 Pickens et al. ..... 123/198 E
6,273,403 B1 * 8/2001 Kahlhamer ..... 261/44.3

* cited by examiner

*Primary Examiner* — Marguerite McMahon
*Assistant Examiner* — James Kim

(57) ABSTRACT

A carburetor cover includes a first portion with a flanged portion extending from an outer edge of the first portion. The first portion includes a plurality of spaced holes and a first opening for receiving a fastener of a carburetor. The spaced holes of the first surface have diameters that are greater than 2 mm and less than 8 mm. A side wall includes a plurality of spaced holes having diameters that are greater than 2 mm and less than 8 mm. One end of the side wall is connected to the flanged portion. Another end of the side wall is configured to be mounted on a surface of the carburetor. Airflow is received directly by the first portion and the side wall without passing through a filter medium. Airflow flows through the carburetor cover directly to an engine without passing through a filter medium.

10 Claims, 4 Drawing Sheets

CARBURETOR COVER

CROSS-REFERENCE TO RELATED APPLICATIONS

This application claims the benefit of 61/335,460, filed on Jan. 7, 2010. The disclosure of the above application is incorporated herein by reference in its entirety.

FIELD

The present disclosure relates to carburetor covers.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Carburetors are used to meter the amount of air and fuel that flows into an internal combustion engine during operation. Carburetors work using vacuum. A throttle plate opens and closes as an operator of the vehicle presses and releases an accelerator pedal. As air is drawn through the throttle plate of the carburetor and into cylinder heads, a metered amount of fuel is added to the air. To prevent damage to the carburetor and engine, most vehicles using carburetors typically employ an air filter. The air filter typically includes a fabric or paper filter medium that filters debris from the air entering the carburetor.

Some enthusiasts race carbureted vehicles at drag strips in timed quarter mile races or other racing events. Since the filter medium of the air filter restricts airflow into the carburetor, the air filters tend to reduce horsepower. Many of these enthusiasts operate the vehicles with unprotected (or open) carburetors to increase performance. However, these enthusiasts are taking the chance that debris may be sucked into the carburetor and/or engine during operation. If the debris is sufficiently large, damage to the carburetor and/or engine may occur.

SUMMARY

A carburetor cover includes a first portion with a flanged portion extending from an outer edge of the first portion. The first portion includes a plurality of spaced holes and a first opening for receiving a fastener of a carburetor. The spaced holes of the first surface have diameters that are greater than 2 mm and less than 8 mm. A side wall includes a plurality of spaced holes having diameters that are greater than 2 mm and less than 8 mm. One end of the side wall is connected to the flanged portion. Another end of the side wall is configured to be mounted on a surface of the carburetor. Airflow is received directly by the first portion and the side wall without passing through a filter medium. Airflow flows through the carburetor cover directly to an engine without passing through a filter medium.

In other features, the diameters of the spaced holes of the first portion and the side wall are greater than 4 mm and less than 6 mm. The first surface and the open side wall are welded together.

In other features, a washer is welded around the first opening of the first portion. A diameter of the carburetor cover is between 5 inches and 6 inches, and a height of the side wall is between 1½ inches and 2½ inches.

In other features, a diameter of the carburetor cover is between 7 inches and 8 inches, and a height of the side wall is between 1½ inches and 2½ inches. The flanged portion of first portion is formed in a die. The carburetor cover is cylinder shaped. The first portion has a circular-shaped cross section.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
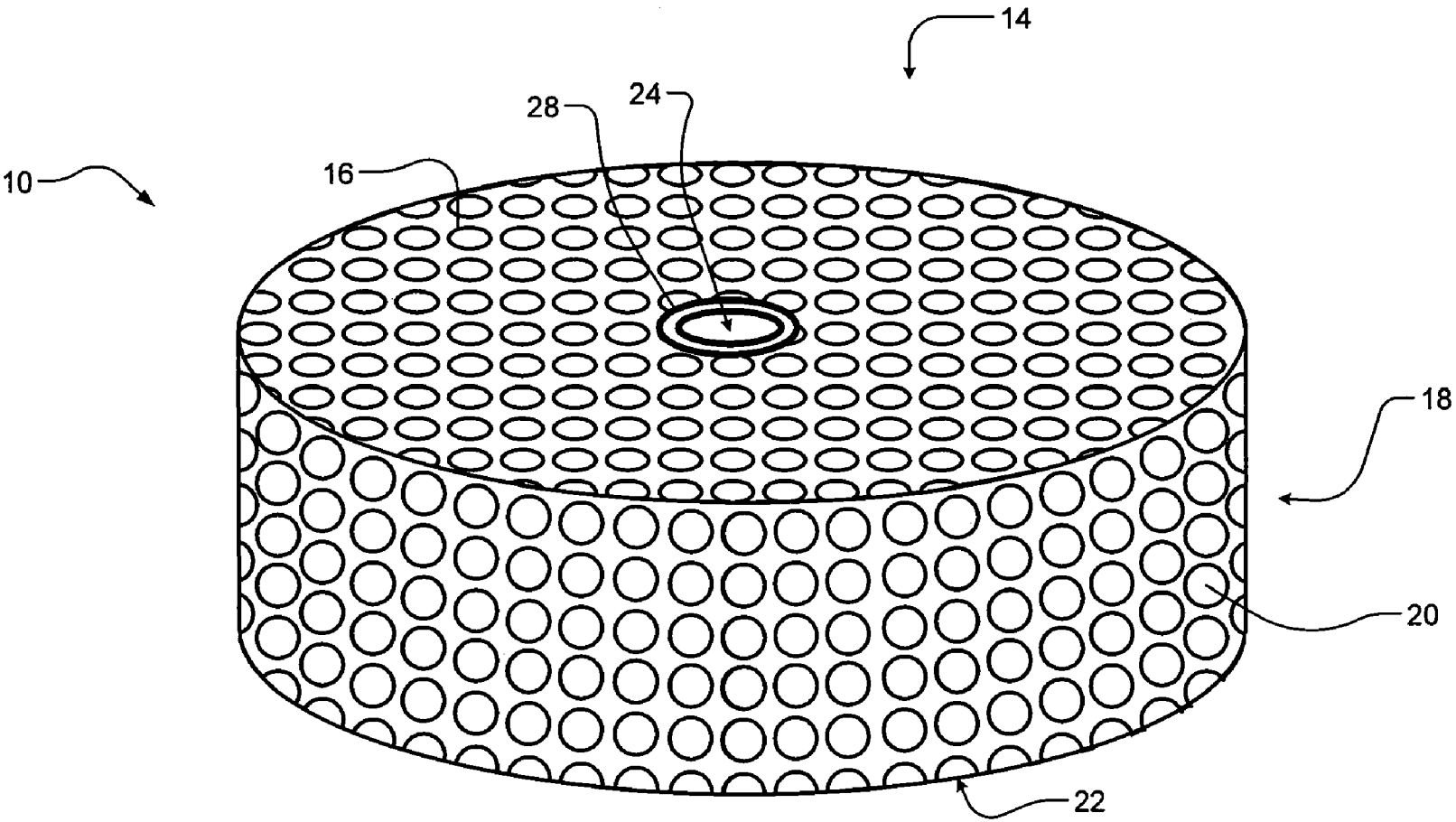
FIG. 1 is a perspective view of an example of a carburetor cover according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

Referring now to FIG. 1, a carburetor cover 10 according to the present disclosure is shown. The carburetor cover 10 includes a first portion 14 and one or more side walls 18. For example only, the first portion 14 may have a circular, square, elliptical, rectangular, polygon or irregular shape in a plan view. In FIG. 1, the first portion 14 is circular and the side wall 18 is ring-shaped. The first portion 14 may be attached to the side wall 18 using any suitable method. For example only, the first portion 14 may be welded to the side wall 18, although other attachment methods may be used.

The first portion 14 and the side wall 18 include spaced holes 16 and 20, respectively. The spaced holes 16 and 20 may have the same diameter or different diameters. The spaced holes 16 and 20 may be uniformly spaced or irregularly spaced. A bottom edge 22 of the side wall 18 is mounted on a carburetor (not shown in FIG. 1). The first portion 14 includes an opening 24. A flat washer 28 may be attached to the first portion 14 and centered with respect to the opening 24. The opening 24 may be centrally located relative to the first portion 14.

Figure 2:
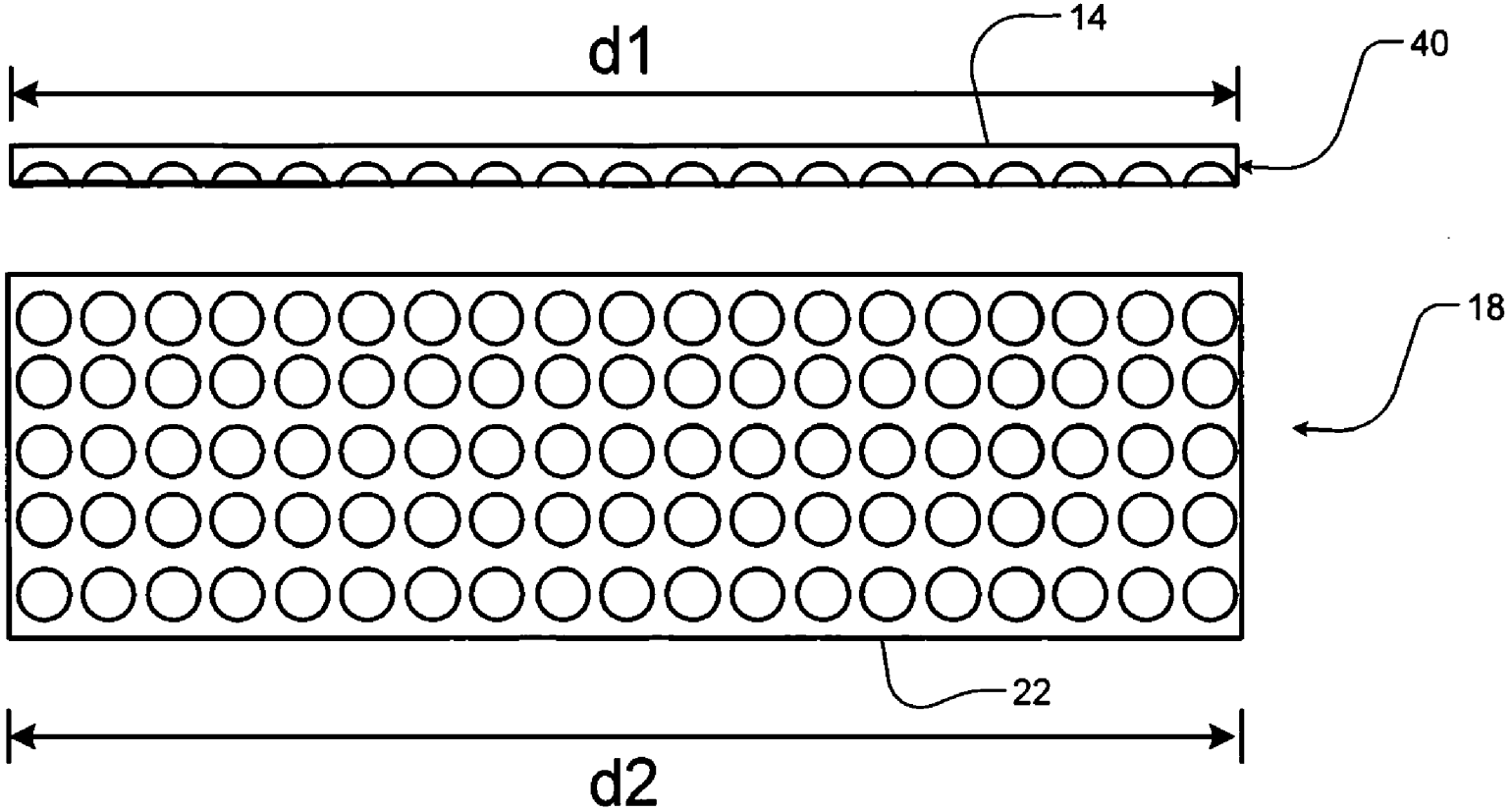
FIG. 2 is a side view of the carburetor cover of FIG. 1 according to the present disclosure.

Referring now to FIG. 2, a side view of the carburetor cover 10 according to the present disclosure is shown. The first portion 14 may have a diameter D1 that is either less than or greater than a diameter D2 of the side wall 18 to allow one of the first portion 14 and the side wall 18 to fit inside of the other of the first portion 14 and the side wall 18. The first portion 14 may be inserted into a die to provide a flanged portion 40, which provides a surface for welding or other attachment to the side wall 18.

Figure 3:
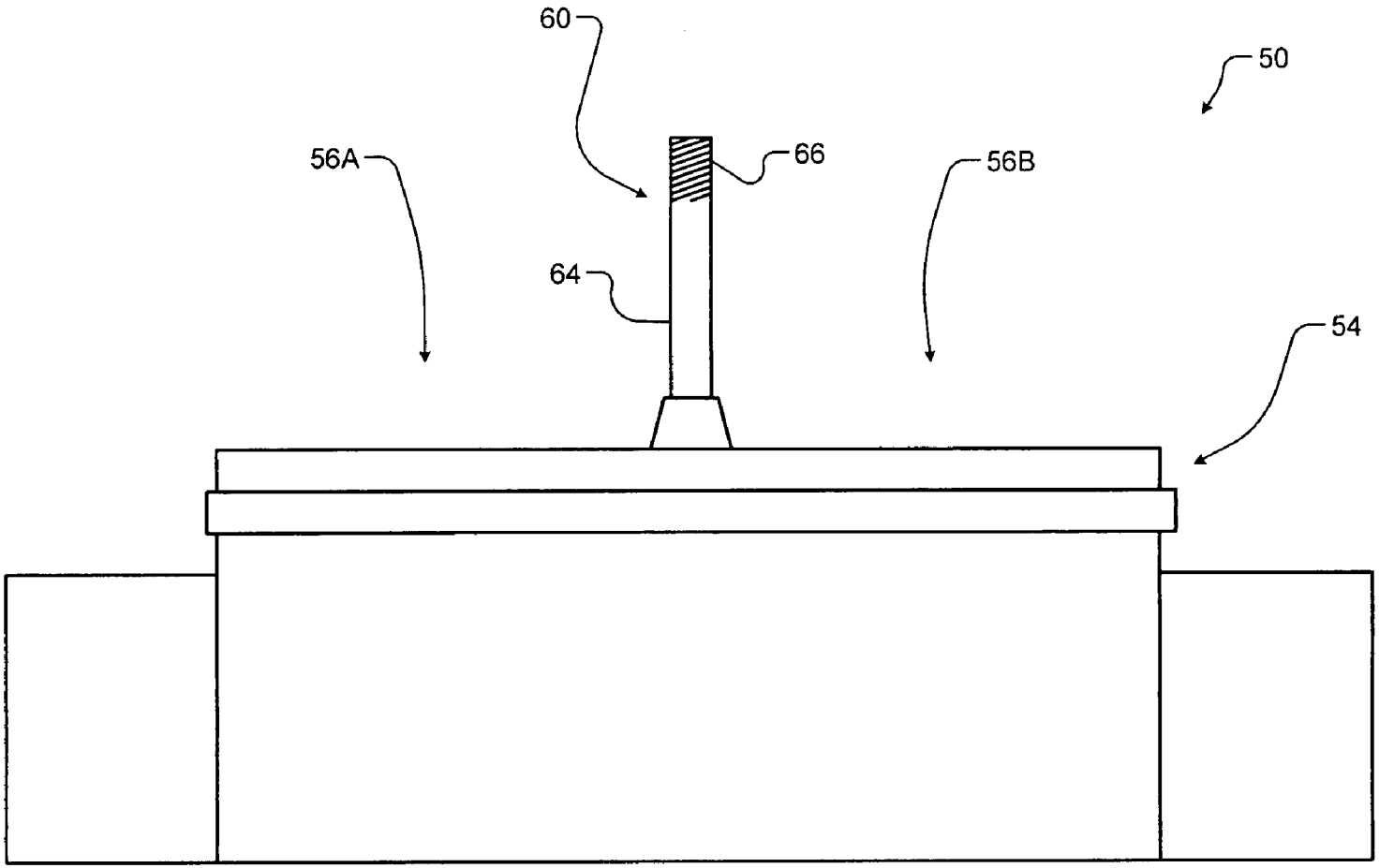
FIG. 3 is a side view of an example of a carburetor.

Referring now to FIG. 3, a side view of a carburetor 50 is shown. The carburetor 50 includes a mounting surface 54 that is configured to receive the bottom edge 22 of the carburetor cover 10. Air enters the carburetor 50 as shown by arrows 56A and 56B. The carburetor 50 further includes a filter mounting fastener 60. For example only, the filter mounting fastener 60 may include a bolt 64 extending from a base portion 65 and having a threaded end 66. The filter mounting fastener 60 may be arranged in a central location of the carburetor 50.

Figure 4:
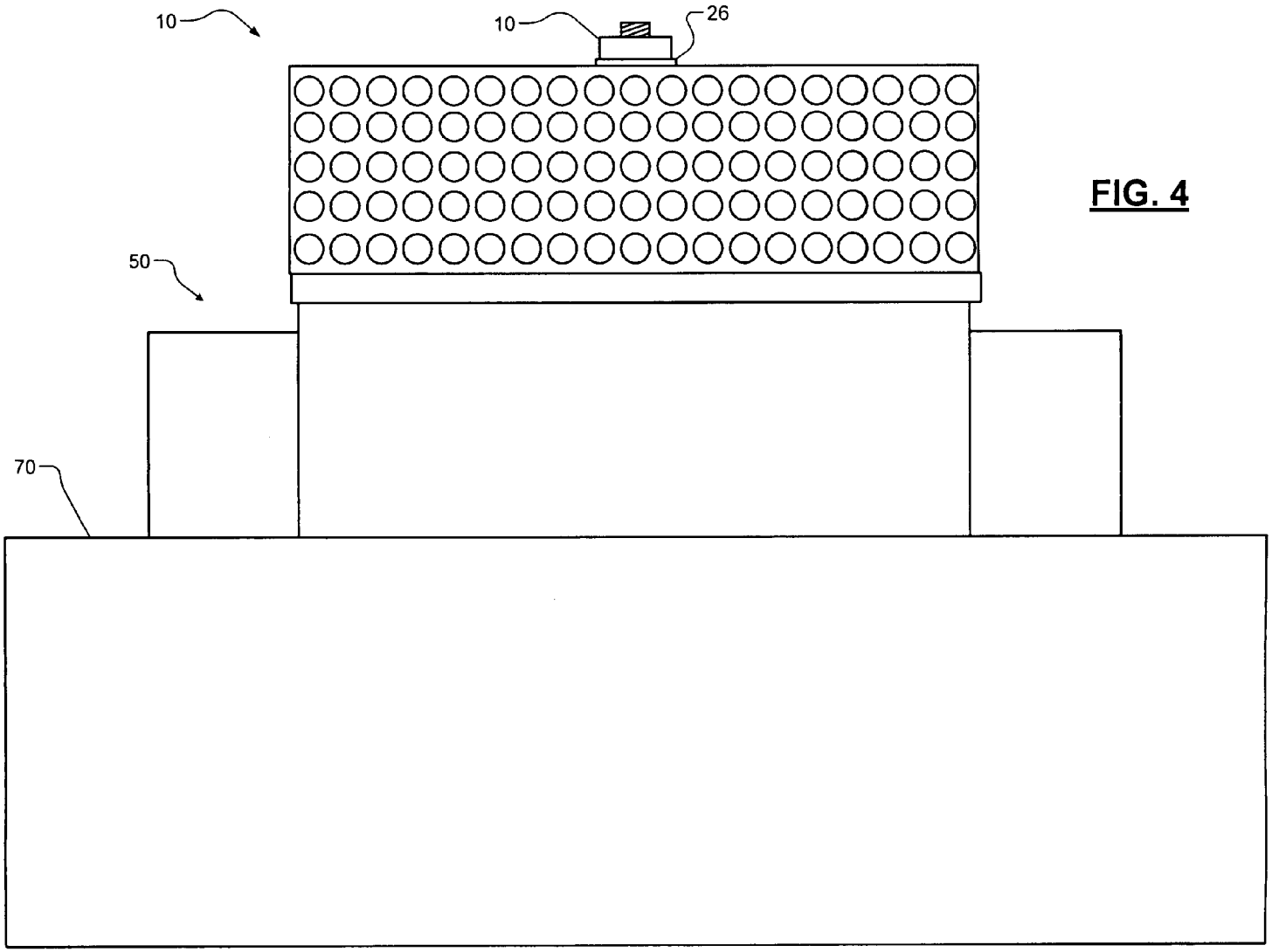
FIG. 4 is a side view of the carburetor cover of FIG. 1 attached to the carburetor of FIG. 3.

Referring now to FIG. 4, the carburetor cover 10 of FIG. 1 is shown mounted on and attached to the carburetor 50 of FIG. 3. The carburetor 50 is generally mounted to a top or side surface of an engine 70. The carburetor cover 10 is mounted onto the carburetor 50 with the filter mounting fastener 60 received through the opening 24. The bottom edge 22 of the carburetor cover 10 is received by the mounting surface 54 of the carburetor 50. A fastener 72 such as a nut is threaded onto the threaded end 66 of the flange mounting fastener 60.

As can be appreciated, the size of the carburetor cover 10 can be adjusted for a particular carburetor application. In one application, the carburetor cover 10 has an outer diameter of approximately 7⅜" and a height of approximately 2 inches. The spaced holes 16 and 20 may have a diameter of approximately 5 mm. The opening 24 is defined by an opening of a 10 mm washer. In another application, the carburetor cover 10 has an outer diameter of approximately 5¼" and a height of approximately 2¼" inches. The holes spaced holes 16 and 20 have a diameter of approximately 5 mm. The opening 24 is defined by an opening of an 8 mm washer.

In other applications, a diameter of the carburetor cover 10 is between 5 inches and 6 inches, and a height of the side walls is between 1½ inches and 2½ inches. The spaced holes 16 and 20 may have a diameter between 2 mm and 8 mm. In other applications, the spaced holes 16 and 20 may have a diameter between 4 mm and 6 mm. In still other applications, a diameter of the carburetor cover 10 is between 7 inches and 8 inches, and a height of the side walls is between 1½ inches and 2½ inches.

The carburetor cover 10 according to the present disclosure protects the carburetor 50 and the engine 70 from intrusion of debris during racing or other operation of the vehicle. Additionally, the carburetor cover 10 allows near maximum airflow. As can be appreciated, maximum horsepower occurs with maximum airflow as compared to applications using air filters with a fabric or paper filter medium. The carburetor cover 10 can also be attached to the engine 70 while work is being done on the engine 70 to prevent debris, small parts, tools and other items from accidently dropping into the carburetor 50.

In addition, the carburetor cover 10 tends to show more of the carburetor 50 and the top of the engine 70. Enthusiasts who like to drag race also tend to spend a lot of money on the appearance of their vehicle. These enthusiasts also like to display their vehicle. Unlike air filters that more completely cover the carburetor 50, the carburetor cover 10 allows more of the carburetor 50 to be seen. The low-profile design of the carburetor cover 10 also eliminates another problem that tends to occur with high performance vehicles. As the engine 70 and carburetor 50 increase in size to provide more horsepower, clearance between the top of the carburetor 50 and a bottom of surface of the hood decreases. When air filters are added to these vehicles, the hood may not close. Therefore, these enthusiasts need to cut holes into their hoods or operate without a hood to use air filters. However, the carburetor cover 10 has a much lower profile allowing the hood to close.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A carburetor cover, comprising:

a Filter housing that includes:

a mounting surface that mates with an air inlet of a carburetor of an engine;

a fastener that fixedly attaches the filter housing to the carburetor, a first portion that includes a flanged portion extending from an outer edge of the first portion, a first plurality of spaced holes and a first opening that receives the fastener wherein the first plurality of spaced holes of the first portion have diameters that are greater than 2 mm and less than 8 mm; and a side wall that has one end that is connected to and circumscribes the flanged portion and that includes a second plurality of spaced holes having diameters that are greater than 2 mm and less than 8 mm, wherein another end of the side wall defines the mounting surface, wherein during operation, an airflow path is defined by airflow from atmosphere directly through the first and second plurality of spaced holes of the filter housing into the air inlet of the carburetor, and wherein the first portion and the side wall of the filter housing acts as a filter medium for objects larger than the diameters of the first and second plurality of spaced holes.

2. The carburetor cover of claim 1, wherein the diameters of the first and second plurality of spaced holes of the first portion and the side wall are greater than 4 mm and less than 6 mm.

3. The carburetor cover of claim 1, wherein the first portion and the side wall are welded together.

4. The carburetor cover of claim 1, further comprising a washer welded around the first opening of the first portion.

5. The carburetor cover of claim 1, wherein a diameter of the first portion is between 5 inches and 6 inches, and a height of the side wall is between 1½ inches and 2½ inches.

6. The carburetor cover of claim 1, wherein a diameter of the first portion is between 7 inches and 8 inches, and a height of the side wall is between 1½ inches and 2½ inches.

7. The carburetor cover of claim 1, wherein the flanged portion of the first portion is formed in a die.

8. The carburetor cover of claim 1, wherein the carburetor cover is cylinder shaped.

9. The carburetor cover of claim 1, wherein the first portion has a circular-shaped cross section.

10. The carburetor cover of claim 1, wherein the flanged portion extends at a right angle from the outer edge of the first portion.

* * * * *